US011213452B2

(12) United States Patent
Carr

(10) Patent No.: US 11,213,452 B2
(45) Date of Patent: Jan. 4, 2022

(54) MASSAGE DEVICE AND METHOD OF USE

(71) Applicant: Daniel Edward Carr, Los Angeles, CA (US)

(72) Inventor: Daniel Edward Carr, Los Angeles, CA (US)

( * ) Notice: Subject to any disclaimer, the term of this patent is extended or adjusted under 35 U.S.C. 154(b) by 0 days.

(21) Appl. No.: 16/657,958

(22) Filed: Oct. 18, 2019

(65) Prior Publication Data

US 2021/0113422 A1 Apr. 22, 2021

(51) Int. Cl.
*A61H 7/00* (2006.01)

(52) U.S. Cl.
CPC ..... *A61H 7/003* (2013.01); *A61H 2201/1253* (2013.01); *A61H 2201/1635* (2013.01); *A61H 2201/1645* (2013.01); *A61H 2201/1692* (2013.01)

(58) Field of Classification Search
CPC ..... A61H 7/003; A61H 2201/1645; A61H 2201/1635; A61H 2201/1253; A61H 2201/1692
See application file for complete search history.

(56) References Cited

U.S. PATENT DOCUMENTS 4,461,285 A * 7/1984 Courtin ..... A46B 9/02 15/110
6,077,239 A * 6/2000 Lin ..... A61H 7/003 601/134
6,241,696 B1 * 6/2001 York ..... A61H 15/0092 601/131
D768,867 S * 10/2016 Hetzel ..... D24/214
2004/0249323 A1 * 12/2004 Louis ..... A61H 7/003 601/135
2004/0249324 A1 * 12/2004 Louis ..... A61H 7/003 601/135
2007/0066919 A1 * 3/2007 Gueret ..... A61H 7/003 601/138
2008/0269848 A1 * 10/2008 Birmingham ..... A61N 5/0617 607/89
2012/0143081 A1 * 6/2012 Lyu ..... A61H 23/006 600/557
2012/0204369 A1 * 8/2012 Watanabe ..... A46B 5/0025 15/110
2017/0340509 A1 * 11/2017 van den Dries ..... A61H 7/003
2017/0340510 A1 * 11/2017 Spewock ..... A61H 7/007
2019/0201283 A1 * 7/2019 Moran ..... A61H 7/003

* cited by examiner

*Primary Examiner* — Quang D Thanh
(74) *Attorney, Agent, or Firm* — Cohen IP Law Group, PC; Michael N. Cohen

(57) ABSTRACT

A massage tool that provides ergonomic support to the user's hands and thumbs is provided. The tool may include a hand grip with a forward extending thumb portion. A series of massage ridges may be positioned beneath the thumb portion such that downward pressure applied to the thumb portion (e.g., by the user's thumb) may be transferred to the ridges to facilitate the massage. Two massage tools may be combined to form a combined massage tool assembly that may be used with two hands.

13 Claims, 13 Drawing Sheets

MASSAGE DEVICE AND METHOD OF USE

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to massage tools, including a manual massage tool with bottom ridges.

BACKGROUND

Muscular scar tissue adhesions are a direct cause of structural chronic pain. However, the scar tissue is very difficult to break down using one's bands or other body parts (e.g., during a body massage). For example, significant pointed downward (e.g., "cross-fiber") pressure must be applied to the scar tissue, and the current technique of applying this pressure using one's thumbs) is difficult to sustain and may cause damage to the hands of the massage therapist, possibly prematurely ending the therapist's career.

Thumb massage tools currently on the market include flat surfaces not adequate to provide the targeted cross-fiber pressure necessary to break down the scar tissue and to lengthen the associated peripheral nerves. In addition, the flat tools are not able to grip the individual muscles (or groups of muscles) as necessary for the breakdown of the scar tissue adhesions. Also these flat tools are designed for a single hand application with no possibility of increasing pressure by using both hands in unison for enhanced cross-fiber friction and nerve lengthening.

Accordingly, there is a need for a massage tool that provides ergonomic support to the massage therapists hands and thumb during use, and that includes ridges that may be used to grip the recipient's muscles as necessary for the elimination of scar tissue adhesions through cross-fiber friction and for the lengthening of associated peripheral nerves. There is also a need for a tool that may be combined with a second tool to provide accurate two-handed pressure for these techniques.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

Figure 1:
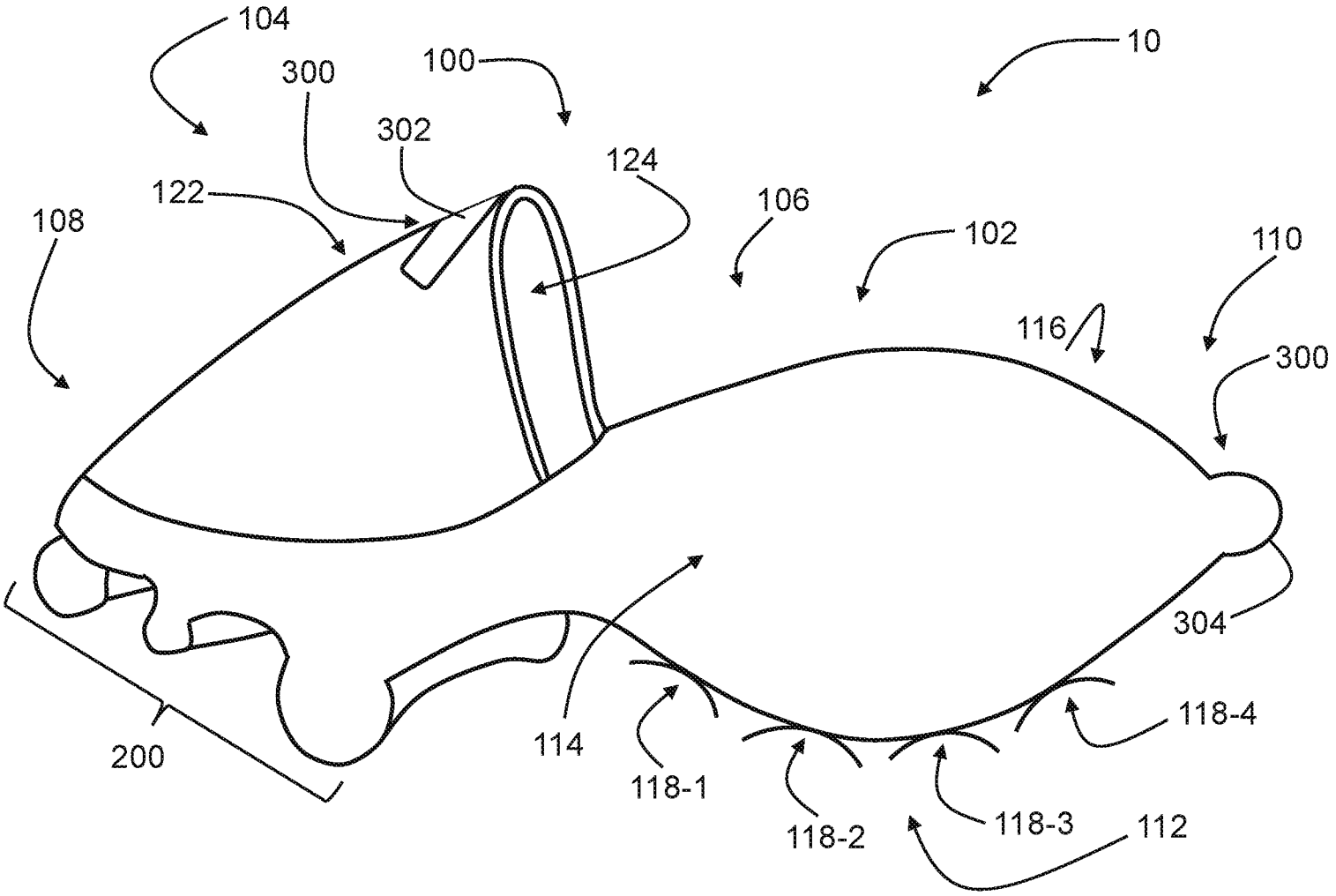
FIG. 1 shows aspects of a massage device according to exemplary embodiments hereof.

In general, the device and method according to exemplary embodiments hereof includes a massage tool for the manipulation of bodily tissues and nerves for therapeutic and/or relaxation purposes, and the tool's method of use thereof.

In some embodiments, the device includes a massage tool with an ergonomic handle. The handle includes a hand grip portion configured with a forward extending thumb portion. The hand grip portion may be held within the palm and fingers of the user's hand while the user's thumb extends forward into the thumb portion. In general, the device may be held within one hand.

The tool may also include underside ridges adapted to contact the bodily tissues and nerves to be massaged. During use, downward and crossward pressure may be applied to the ridges by the user's thumb and hand. In this way, the device may be used to facilitate the massage.

In some embodiments, two devices may be attached together to form a two-hand massage tool assembly.

Further details of the device, as well as the device's methods of use will be described in detail below.

The following detailed description is not intended to limit the current invention. Alternate embodiments and variations of the subject matter described herein will be apparent to those skilled in the art.

Referring now to FIGS. 1-13, the device 10 according to exemplary embodiments hereof will be described in further detail. Where the same or similar components appear in more than one figure, they are identified by the same or similar reference numerals.

In one exemplary embodiment as shown in FIG. 1, the device 10 may include a handle portion 100, an underside ridge portion 200 and an attachment system 300. The attachment system 300 may facilitate the attachment of two or more devices 10 together to form a multi-device assembly 400. The device 10 may include other elements and/or components that may be necessary for the device 10 to perform its desired functionalities as described in this specification.

Handle Portion

In some exemplary embodiments hereof as shown in FIG. 1 the device 10 includes a handle portion 100 comprising a hand grip portion 102 and a thumb portion 104. In general, the thumb portion 104 is positioned forward of the hand grip portion 102.

In some embodiments, the device 10 may be adapted to be held within the right hand, the left hand, and/or using either hands. As will be described below, in some embodiments, design elements of the device are specific to a right-handed device or a left-handed device. In other embodiments, the design elements may allow use of the device by either the right hand or the left hand.

For the purposes of this specification, the device 10 will be described with reference to a right-handed device (to be used with the right hand). However, it is understood by a person of ordinary skill in the art that the details described may also pertain to a left-handed device (possibly mirrored as necessary) and/or a device that may be used with either hand. It is also understood that the scope of the device is not limited in any way by the hand with which it is used.

The handle portion 100 may generally include a top 106, a front 108, a back 110, a bottom 112, a left side 114 and a right side 116. The hand grip portion 102 may be formed to ergonomically fit the anatomical features and contours of a human hand when the hand is placed on the grip 102. The hand grip 102 may preferably be formed of silicon or other types of natural and/or synthetic rubber and may also be formed of other materials such as plastics, leather, synthetic leather, wood or other types of materials. Accordingly, the hand grip 102 may be molded, sculpted, sewn or otherwise manufactured. The hand grip 102 may also be formed of a combination of types of materials. For example, the core of hand grip 102 may be formed of a plastic or a hard rubber while the outer surface of the hand grip 102 may be formed of a soft silicon layer. Other types and combinations of materials may also be used.

When grasping the hand grip 102, the palm of the user's right hand may generally contact the top 104 and right side 116 of the grip 102, with his/her fingers generally extending from the right side 116 across the bottom 112 to the left side 114. In this position, the thumb of the user's hand may extend forward towards the front 104 of the grip portion 102 and into the thumb portion 104.

On the underside 112, the hand grip 102 may include one or more finger recesses 116 that may resemble channels or indentations. It may be preferable that the hand grip 102 include up to four finger recesses 118-1, 118-2, 118-3 and 118-4 (collectively and individually 118), one for each finger of the human hand. Referring to the right-handed tool 10 of FIG. 1, finger recess 118-1, being on the far left, may be formed to receive and accommodate the user's index finger, finger recess 118-2 may be formed to receive and accommodate the user's middle finger, finger recess 118-3 may be formed to receive and accommodate the user's ring finger, and finger recess 118-4 may be formed to receive and accommodate the user's small finger.

However, other numbers of finger recesses 118 may also be used (e.g., one finger recess 118-1 for the user's index finger only) and the number of finger recesses in no way limits the scope of the device 10. It is also understood the hand grip 102 may not include finger recesses 118 and that the hand grip 102 may instead be smooth, include a texture or other type of patterned surface and any combination thereof.

In one exemplary embodiment hereof, the thumb portion 104 extends forward from the hand grip portion 102 a distance that may accommodate the thumb of the user's hand. The thumb portion 104 is formed and adapted to provide ergonomic support to the user's thumb (e.g., the thumbprint area of the thumb) when in use. The lower surface 120 (shown in FIG. 3) of the thumb portion 104 may be smooth or textured and may generally follow the proper curvature to comfortably and ergonomically support the user's thumb. In this way, the user of the device 10 may use his/her thumb to apply downward pressure to the thumb portion 104 and to the massage ridges beneath (as will be described in other sections).

Figure 2:
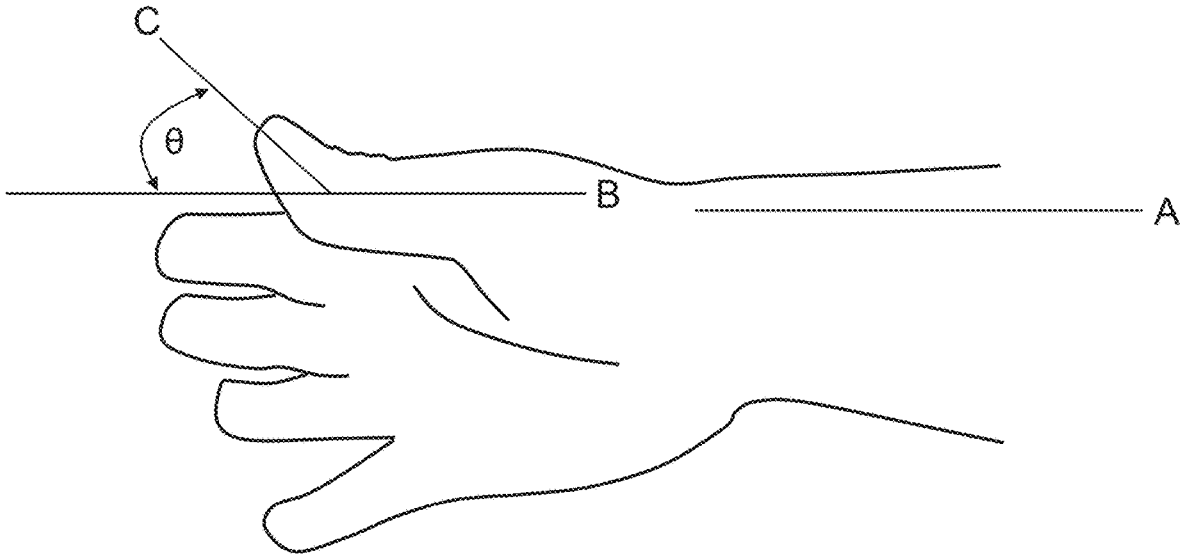
FIG. 2 shows aspects of arm, hand and thumb alignment according to exemplary embodiments hereof.

The proper ergonomic alignment of the user's arm and hand for applying thumb pressure to a recipient during a massage is shown in FIG. 2. As shown, the user's arm and hand may preferably be held with the user's radius bone (represented by line A) generally aligned parallel with the user's thumb (the thumb's metacarpal, proximal phalange and medial phalange as represented by line B). The distal phalange of the thumb (represented by line C) is preferably held at a 45° angle (θ) with respect to the radius bone (line A) and the thumb's metacarpal, proximal phalange and medial phalange (line B).

Figure 3:
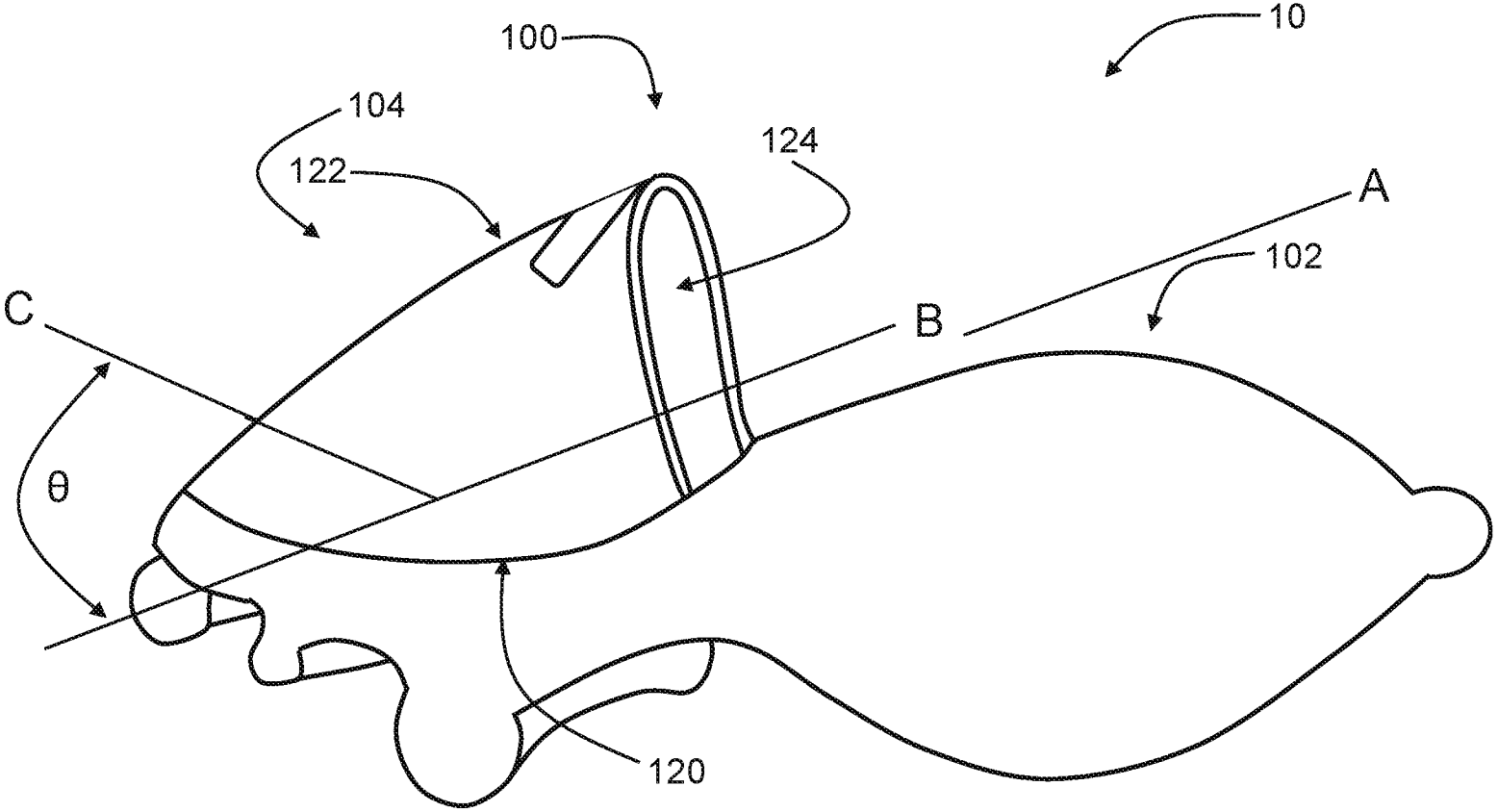
FIGS. 3-4 show aspects of a massage device according to exemplary embodiments hereof.

Accordingly, as shown in FIG. 3, the device 10 is structured to support the user's arm, hand and thumb in the proper ergonomic positions as described. As shown, the thumb portion 104 is oriented with respect to the hand grip portion 102 such that when the user grips the hand grip portion 102 with his/her hand, his/her radius bone (line A) is generally aligned parallel to his/her thumb (the thumb's metacarpal, proximal phalange and medial phalange as represented by line B), and the thumb's distal phalange (line C) is supported at a 45° angle (θ) by the sloping curvature of the thumb portion's bottom surface 120. That is, the curvature of the bottom surface 120 transitions within the thumb portion 104 from aligning generally parallel to line B to aligning generally parallel to line C.

By aligning and supporting the user's thumb (the thumb's metacarpal, proximal phalange and medial phalange as represented by line B) with the user's radius bone (line A), and by aligning and supporting the user's thumb's distal phalange (line C) at a 45° angle (θ) with respect to the thumb (line B) and the radius bone (line A), proper massage arm/hand/thumb ergonomics is achieved. In this way, the device 10 facilitates the application of downward pressure through the device 10 to the massage recipient while minimizing stress to the user's arm, hand and thumb.

It is understood that the thumb portion 104 may be adapted to support the user's thumb's distal phalange (line C) at any angle as necessary, and that the angle θ of 45° as described in the above example is meant for demonstration. For example, the thumb portion 104 may support the user's thumb's distal phalange at 30°, 35°, 40°, 50°, 55°, 60° and at other angles. It is also understood that the scope of the device 10 is not limited in any way by the angle at which the thumb portion 104 may support the user's thumb's distal phalange.

In one exemplary embodiment hereof, the thumb portion 104 includes an upper support 122 that forms an inner thumb cavity 124 with relation to the bottom surface 120. The inner thumb cavity 124 (also referred to as the thumb tunnel) is adapted to receive the user's thumb while in use. The cavity 124 may enclose the entirety of the user's thumb while in use, or any portion thereof, without obstructing the thumb. As will be described in other sections, the upper support 122 may be configured with the attachment system 300.

Underside Ridge Portion

Figure 4:
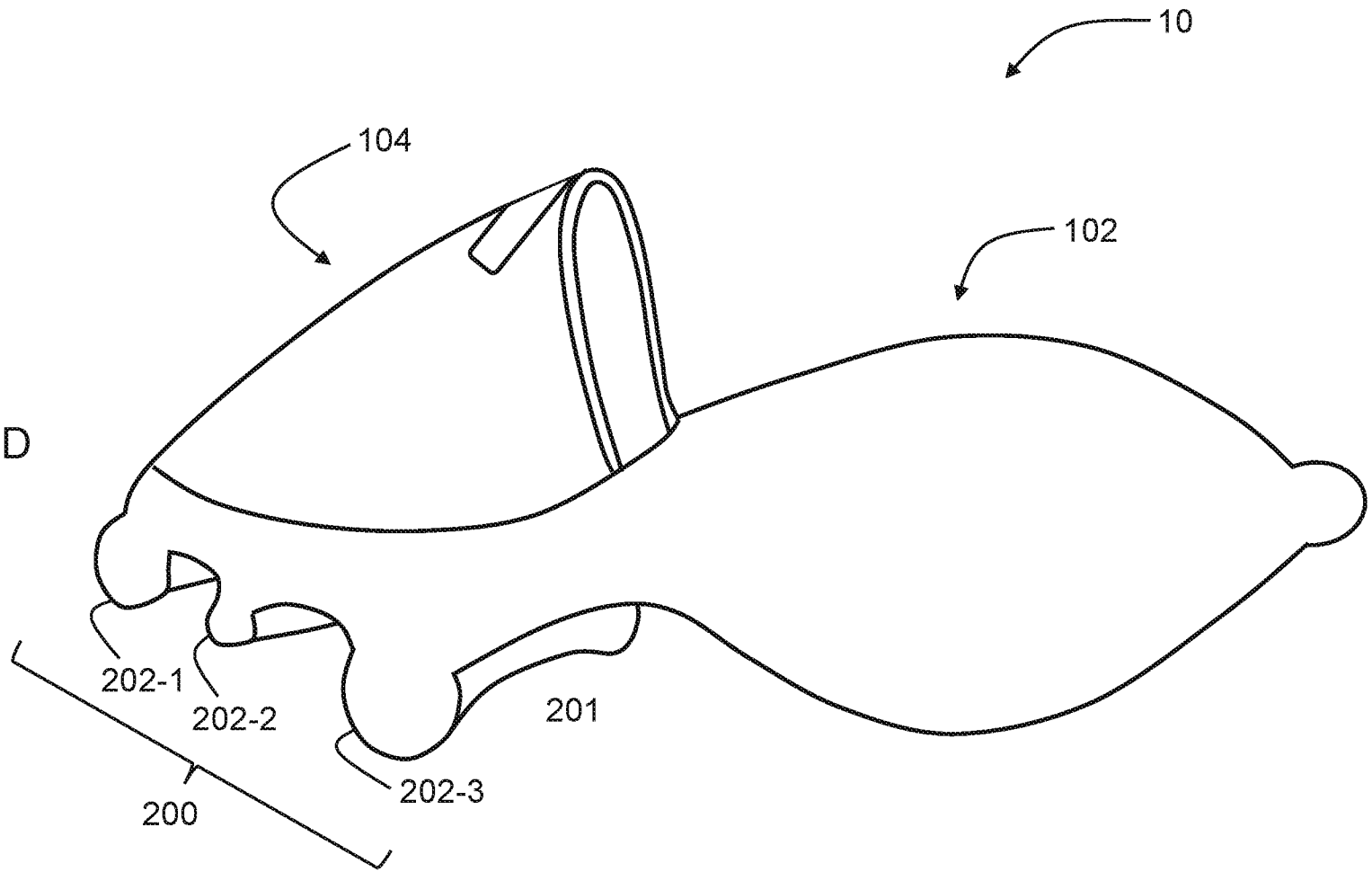

In one exemplary embodiment hereof as shown in FIG. 4, the underside ridge portion 200 is configured generally on the underside of the thumb portion 104. The ridge portion 200 may include an underside surface 201 (represented by line D) from which the underside ridges 202 may extend downward. In this way, downward and crossward pressure applied by the user's thumb and hand to the thumb portion 104 (and grip portion 102) while using the device 10 is transferred to the underside ridge portion 200. The underside ridge portion 200 is placed into physically contact with the bodily tissues of the massage recipient to facilitate the massage.

In one exemplary embodiment hereof, the downward extending ridges 202 extend downward generally perpendicular to the longitudinal axis of the handle portion 100 (defined as the axis that extends from the back 110 of the handle portion 100 to the front 108 of the handle portion 100. In other embodiments the downward extending ridges 202 extend downward at an offset angle with respect to the longitudinal axis of the handle portion 100 (e.g., at 45° with respect to the longitudinal axis).

Figure 5:
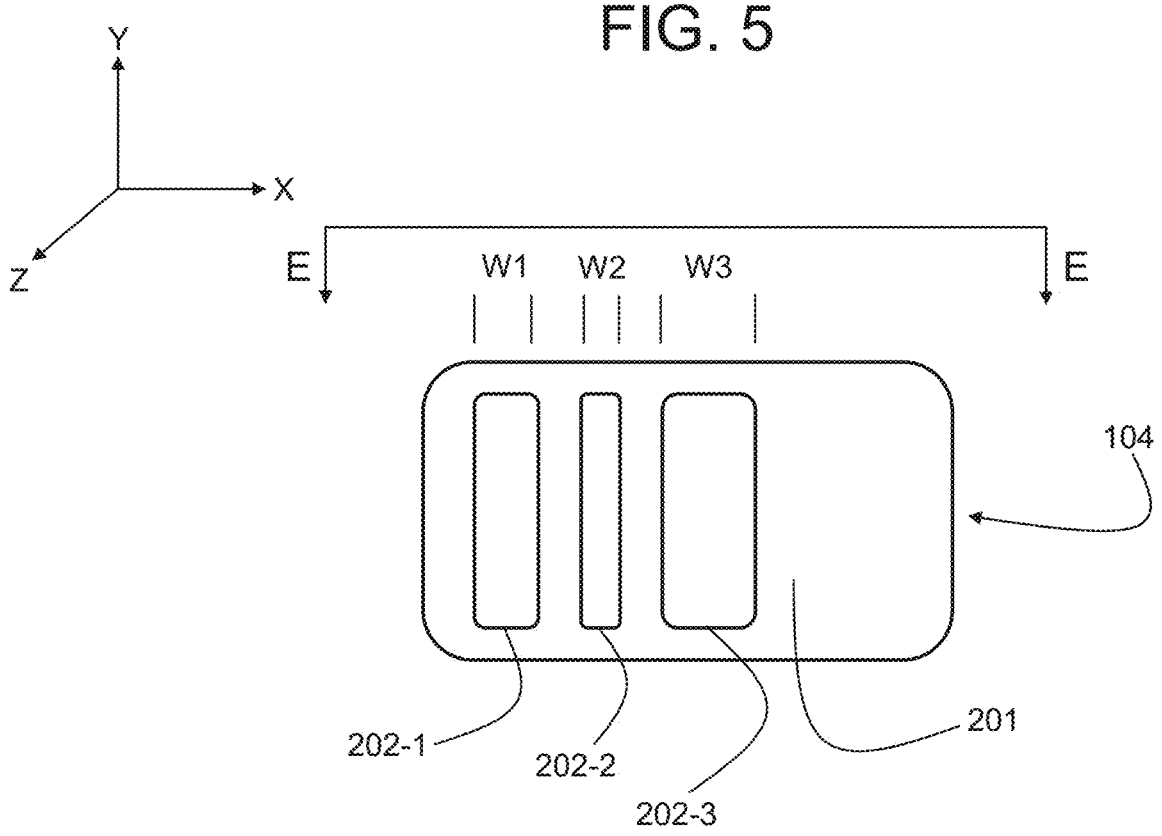
FIG. 5 shows aspects of a massage device thumb portion according to exemplary embodiments hereof.

In one exemplary embodiment hereof as shown in FIGS. 4 and 5, the underside ridge portion 200 includes three individual ridges 202-1, 202-2 and 202-3 (collectively and individually 202). In one embodiment, the ridges 202 are generally aligned sequentially along the X-axis (from left to right) as shown in FIG. 5. In some embodiments, the width W2 of ridge 202-2 is less than the widths W1 of ridge 202-1 and W3 of ridge 202-3. In one embodiment, the width W1 of ridge 202-1 is less than the width W3 of ridge 202-3 (W2<W1<W3). However, it is understood that the widths W1, W2 and W3 may be of any proportion with respect to one another for different purposes. In one embodiment, the lengths (along the Y-axis) of the ridges 200 may be the same or similar (may generally match), different (may generally not match) or any combination thereof. In addition, the lengths (along the Y-axis) of the ridges 202 may be the same, similar or different than the dimension of the thumb portion 104 along the Y-axis in the area of the ridges 202.

In some embodiments, the widths W1, W2 and W3 may be 1/16"-3/16", 1/32"-1/8", 1/8"-1/4", respectively. In some embodiments, the widths W1, W2, W3 may be 1/32"-1/4", 1/32"-1/4", 1/16"-3/8", respectively. In some embodiments, the widths W1, W2, W3 may be 1/8", 1/16" and 3/16" respectively. In some embodiments, the widths W1, W2, W3 may be 3/16", 1/8" and 1/4", respectively. It is understood that the example widths shown above for W1, W2 and W3 are meant for demonstration purposes and that the widths W1, W2, W3 (as well as the widths Wn of any other ridges 200-*n*) may be any dimension as required by the device 10, and that the scope of the device 10 is not limited in any way by the width dimensions of the ridges W1, W2, W3, . . . Wn.

In one embodiment, the spacing between the ridges 202 (e.g., between ridge 2021 and 202-2, and between 202-2 and 202-3) may be the same or similar (may generally match), different (may generally not match) or any combination thereof. In some embodiments, the spacing between the ridges 202 may be 0-1.0 inches. For example, in some embodiments, the spacing between the ridge 202-1 and the ridge 202-2 may be 3/8"-3/4". In other embodiments, the spacing between the ridge 202-1 and the ridge 202-2 may be 1/2", 5/8", 3/4" or other spacings. In some embodiments, the spacing between the ridge 202-2 and the ridge 202-3 may be 1/2"-1". In other embodiments, the spacing between the ridge 202-2 and the ridge 202-3 may be 5/8", 3/4", 7/8" or other spacings. It is understood that the distances between the ridges 202-1 and 202-2, and between 202-2 and 202-3, and between the ridges 202-1, 202-2, 202-3 and any other ridges 202-*n* may include any distances depending on the desired application of the device 10 and that the scope of the device 10 is not limited in any way by the spacings between any of the ridges 202.

In some embodiments hereof, the ridges 202 may be generally linear with constant widths along the Y-axis. In other embodiments, the ridges 202 may include curvatures or varying widths along the Y-axis. In other embodiments, some of the ridges 202 may be linear with constant widths along the Y-axis while other ridges 202 may include curvatures or varying widths along the Y-axis. For example, some of the ridges 202 may include an arc shape.

In some embodiments, one or more of the ridges 202 may be parallel with respect to one or more other ridges 202. In other embodiments, one or more of the ridges 202 may be non-parallel with respect to one or more other ridges 202.

Figure 6:
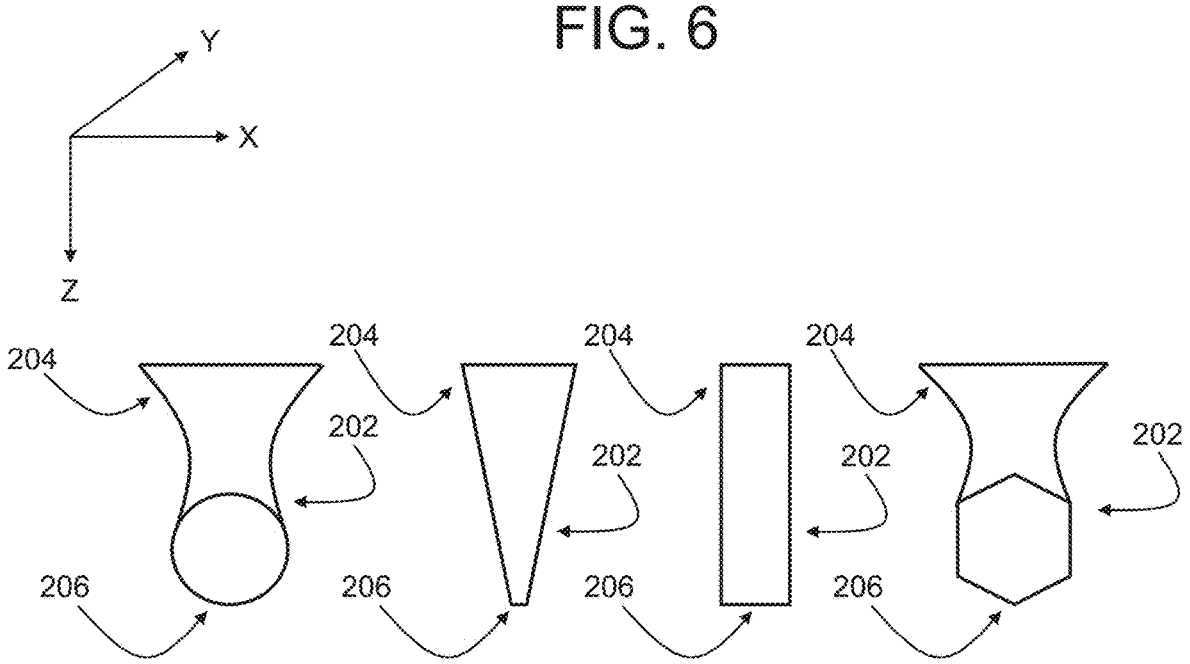
FIGS. 6-7 show aspects of a massage device ridges to exemplary embodiments hereof.

FIG. 6 shows exemplary cross-sections of the ridges 202 taken along cut-lines E of FIG. 5. The ridges 202 may include a base 204 generally configured with the underside surface 201 (line D) and a tip 206. Any of the ridges 202 may include any type of cross-sectional shape as required. The cross-sectional shapes of each ridge 202 may be designed for the purposes of the types of massages, muscle treatments, nerve treatments and other design criteria of the device 10. As shown, some of the ridges 202 may include rounded tips, pointed tips, flat tips, multi-angular tips, other types of tips and any combination thereof. The cross-sectional shapes of the ridges may generally match or may be different. The cross-sectional shapes of the ridges 202 may also vary along the Y-axis (e.g., in shape, in size, in length (e.g., along the Z-axis), etc.).

It is understood that the cross-sectional shapes shown in FIG. 6 are meant for demonstrational purposes and that any of the ridges 202 may include other types of cross-sectional shapes or combinations of cross-sectional shapes not necessarily shown. It is also understood that the scope of the device 10 and of the ridges 202 is not limited in any way by the type of cross-sectional shape that each or any of the ridges 202 may include.

In addition, in some embodiments, the lengths of the ridges 200 (along the Z-axis of FIG. 6) may be any suitable length, for example, 1/8"-2". In some embodiments, the length of the ridges 200 (along the Z-axis of FIG. 6) may be about 1". The lengths of the ridges 200 may or may not match one another, and it is understood by a person of ordinary skill in the art that the ridges 200 may have any suitable lengths (along the Z-axis of FIG. 6) and that the scope of the device 10 is not limited in any way by the lengths of the ridges 200.

Figure 7:
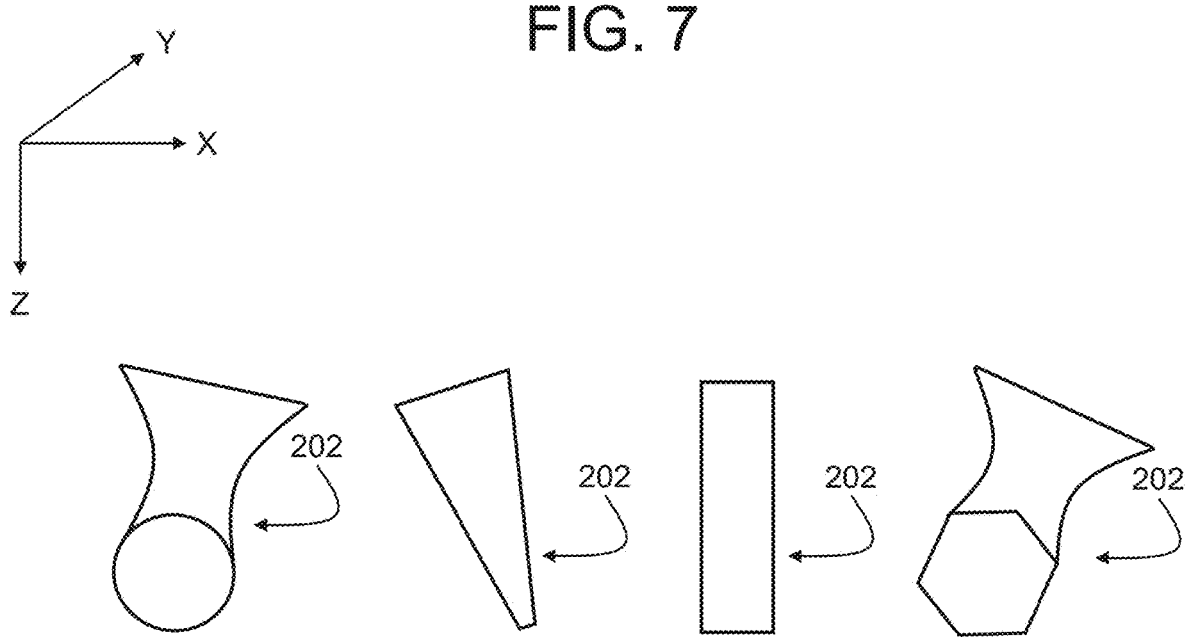

In addition, as shown in FIG. 6, the downward angle of the ridges 202 may be generally perpendicular with respect to the underside surface 201 (represented by line D in FIG. 4) and/or the user's thumb's distal phalange (line C of FIG. 3) when in use. Also, as shown in FIG. 7, any of the ridges 202 may be placed at any offset angle with respect to the underside surface 201 and/or the thumb's distal phalange. It is understood that the angular offsets shown in FIG. 7 are meant for demonstrational purposes and that the ridges 202 may be offset at any angle. In addition, each ridge's angular offset need not match any other ridge's angular offset, but they may as desired. It is understood that the scope of the device 10 and of the ridges 202 is not limited in any way by the angle at which any of the ridges 202 may extend.

It is understood by a person of ordinary skill in the art, upon reading this specification, that while the example described above includes a total of three ridges (202-1, 202-2, 202-3) included on the ridge portion 200, the ridge portion 200 may include any number of ridges 202-*n* as desired. For example, the ridge portion 200 may include one ridge 202, two ridges 202, four ridges 202, five ridges 202, six ridges 202 and other numbers of ridges 202. It is also understood that the scope of the device is not limited in any way by the number of ridges 202 that may be included in the ridge portion 200.

In addition, the ridge portion 200 may extend beyond the underside of the thumb portion 104 to the underside of the hand grip portion 102 such that ridges 202 may also be positioned beneath the hand grip portion 102. Note also that while the example described above shows the ridges 202 generally positioned on the bottom 112 of the handle portion 100, ridges 202 also may be positioned on (or extend onto)

other areas of the handle portion 100 such as the front 108, the back 110, the left side 114, the right side 116 and any combination thereof.

The Attachment System and the Combined Device Assembly

In one exemplary embodiment hereof, the device 10 may include an attachment system 300 that may facilitate the attachment of two or more devices 10 together to form a multi-device assembly 400.

Figure 8:
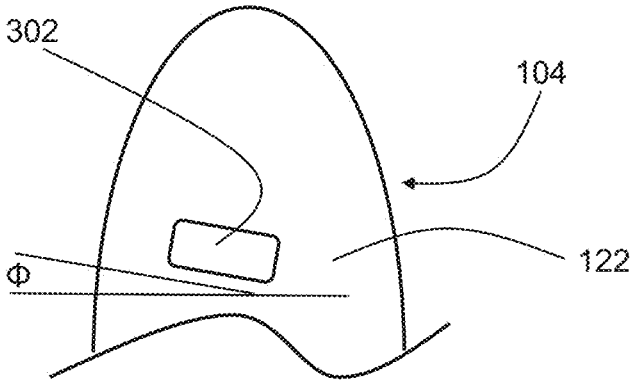
FIG. 8 shows aspects of a massage device attachment system according to exemplary embodiments hereof.

As shown in FIGS. 1 and 8, the attachment system 300 may include an upper slot 302 and a rear tab 304. In one embodiment, the upper slot 302 is configured with the top of the thumb portion's upper support 122 and the rear tab 304 is configured with the back 110 of the handle portion 100. Note that the rear tab 304 may also be used as a massage ridge (similar to ridges 202 but placed at the rear of the handle portion 100).

Figure 9:
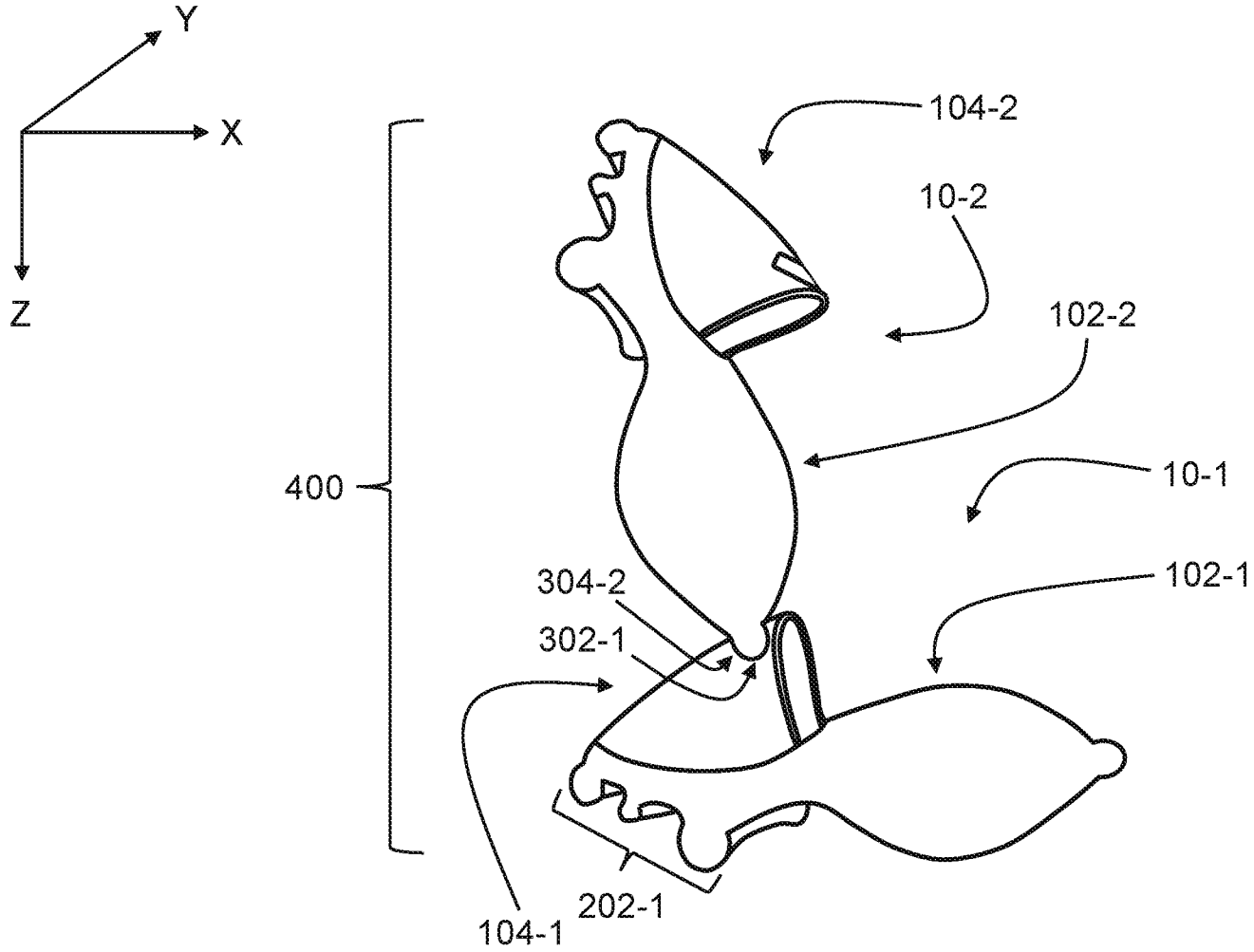
FIG. 9 shows aspects of a combined assembly according to exemplary embodiments hereof.

In one exemplary embodiment hereof as shown in FIG. 9, the slot 302-1 of a first device 10-1 is adapted to receive and secure the rear tab 304-2 of a second device 10-2 to form a combined device assembly 400. Accordingly, the slot 302-1 may have a size and shape that may generally correspond to the size and shape of the rear tab 304-2. It is preferable that the rear tab 304-2 may be received and secured within the slot 302-1, and subsequently removed from the slot 302-1, without excessive force. It is also preferable that the rear tab 304-2 be held securely within the slot 302-1 while in use. The rear tab 304-2 may be held securely within the slot 302-1 by pressure fit, detents or other securing techniques.

With the rear tab 304-2 of the second device 10-2 secured within the slot 302-1 of the first device 10-1, the second device 10-2 may be generally positioned upright with respect to the first device 10-1. In this configuration, a user's first hand (e.g., the user's right hand) may grip the hand grip portion 102-1 of the first device's handle portion 100-1 with the right hand thumb extending forward into the thumb portion 104-1. In addition, the user's second hand (e.g., the user's left hand) may grip the hand grip portion 102-2 of the second device's handle portion 100-2. The user's left hand thumb may or may not extend forward into the second device's thumb portion 104-2. In this configuration, the user may grasp the combined device assembly 400 with both hands to facilitate precise control of the assembly 400 and the assembly's lower ridges 202-1 (the ridges 202-1 of the first device 10-1) during use.

Figure 10:
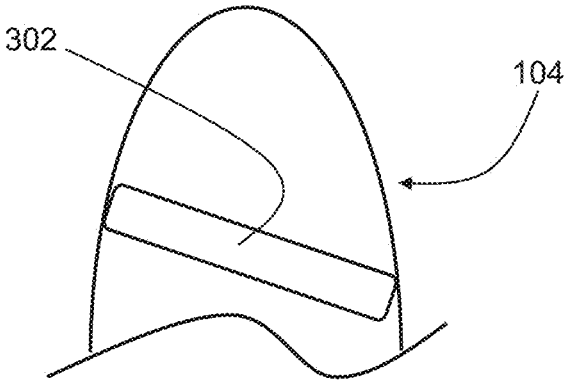
FIG. 10 shows aspects of a massage device attachment system according to exemplary embodiments hereof.
Figure 11:
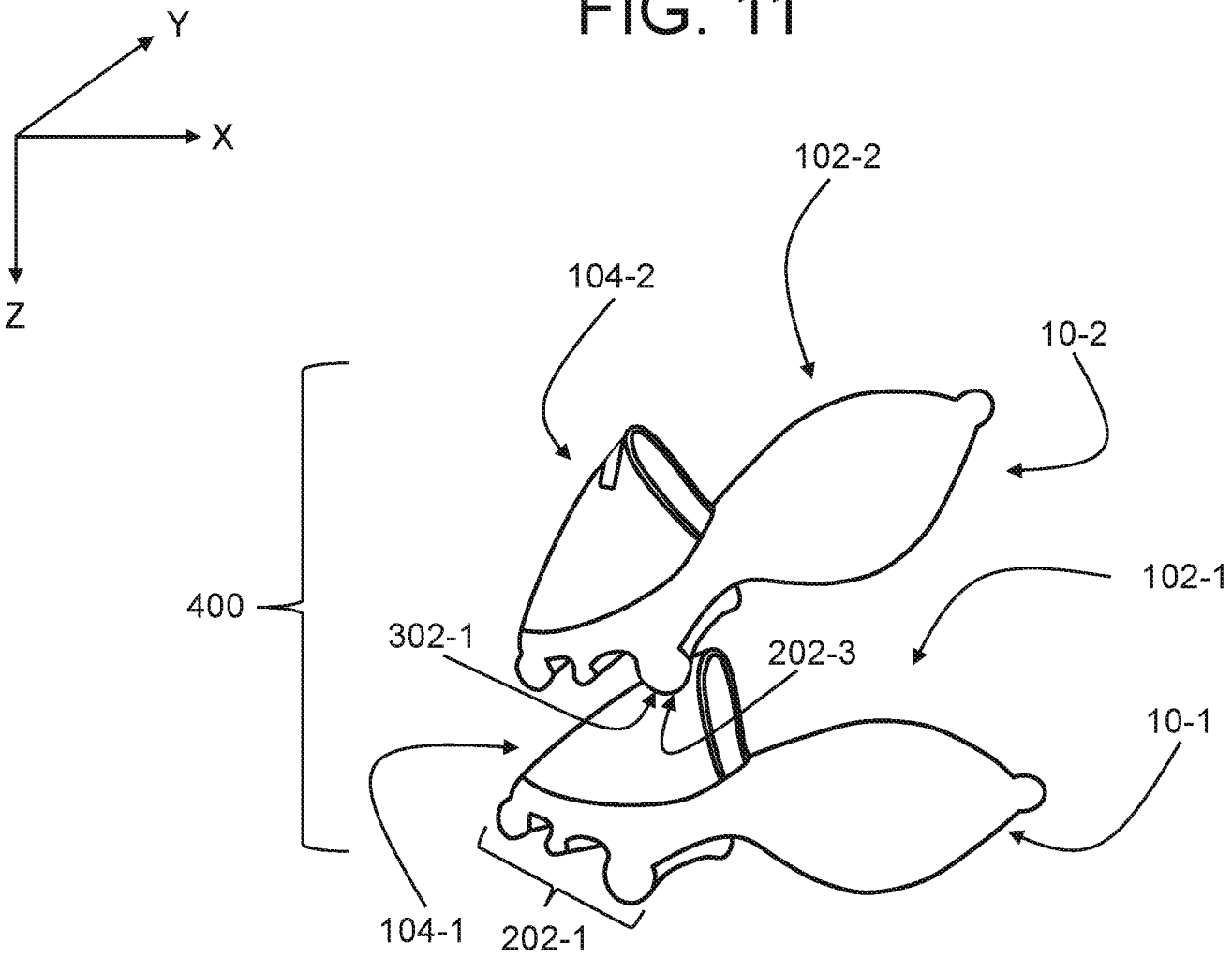
FIG. 11 shows aspects of a combined assembly according to exemplary embodiments hereof.

In one exemplary embodiment hereof as shown in FIGS. 10 and 11, the slot 302-1 of a first device 10-1 is adapted to receive and secure the rear tab 304-2 of a second device 10-2 to form a combined device assembly 400. Accordingly, the slot 302-1 may have a size and shape that may generally correspond to the size and shape of the second device's (10-2) ridge 202-3. It is preferable that the ridge 202-3 may be received and secured within the slot 302-1, and subsequently removed from the slot 302-1, without excessive force. It is also preferable that the ridge 202-3 be held securely within the slot 302-1 while in use. The ridge 202-3 may be held securely within the slot 302-1 by pressure fit, detents or other securing techniques.

With the ridge 202-3 of the second device 10-2 secured within the slot 302-1 of the first device 10-1, the second device 10-2 may be generally positioned above and at an upright angle with respect to the first device 10-1. In this configuration, a user's first hand (e.g., the user's right hand) may grip the hand grip portion 102-1 of the first device's handle portion 100-1 with the right hand thumb extending forward into the thumb portion 104-1. In addition, the user's second hand (e.g., the user's left hand) may grip the hand grip portion 102-2 of the second device's handle portion 100-2 with the user's left hand thumb preferably extending forward into the second device's thumb portion 104-2. In this configuration, the user may grasp the combined device assembly 400 with both hands to facilitate precise control of the assembly 400 and the assembly's lower ridges 202-1 (the ridges 202-1 of the first device 10-1) during use.

In some exemplary embodiments hereof, the first and second combined devices 10-1, 10-2 (e.g., the embodiments of FIGS. 9 and/or 11) may be angularly offset about the Z-axis. That is, the second device 10-2 may be rotated about an axis perpendicular to the longitudinal axis (defined as the axis extending from the back 110 of the handle 100-1 to the front 108 of the handle 100-1) of the first device 10-1. For instance, as shown in FIG. 8, the slot 302 may be placed at an angle Φ with respect to the horizontal plane. As such, when the second device 10-2 is engaged with the slot 302, the second device 10-2 will also be placed at an angle of with respect to the same horizontal plane. This offset angle Φ may allow for the right and left hands of the user to be placed at a more natural position while gripping the first and second devices 10-1, 10-2 (that is, the combined assembly 400).

In some embodiments, the angle Φ may be about 20°. In other embodiments, the angle Φ may be 0°, 5°, 10°, 15°, 25°, 30°, 35°, 40°, 45° and other angles. In another example, the angle Φ may be in the range of 0°-90°. It is understood that the angle Φ may be any angle as required to place the first and second devices 10-1, 10-2 at ergonomic angles for use.

Figure 12:
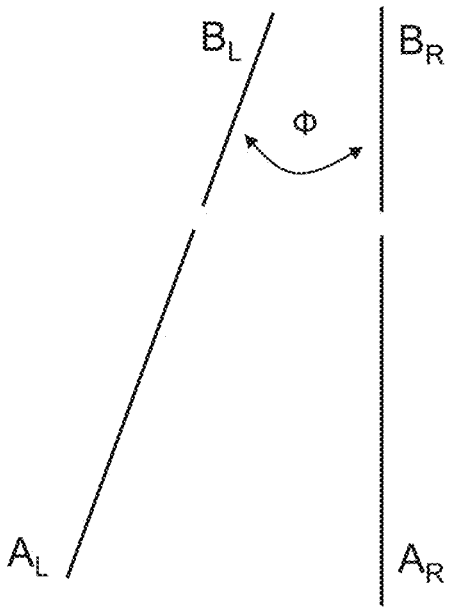
FIG. 12 shows aspects of aligned arms and thumbs according to exemplary embodiments hereof.

In addition, as shown in FIG. 12, the offsetting of the combined devices 10-1, 10-2 may facilitate the proper orientations of the user's left and right arm, hands and thumbs while using the combined assembly 400. As shown, the user's left radius bone (represented by line $A_L$) may be aligned generally parallel to the user's left thumb (the thumb's metacarpal, proximal phalange and medial phalange as represented by line $B_L$), and the user's right radius bone (represented by line $A_R$) may be aligned generally parallel to the user's right thumb (the thumb's metacarpal, proximal phalange and medial phalange as represented by line $B_R$). In addition, the user's left radius bone and left thumb (lines $A_L$ and $B_L$) may be offset from the user's right radius bone and right thumb (lines $A_R$ and $B_R$) by the angle Φ. By properly orientating the user's left and right radius bones and thumbs, the user's arms and hands may provide stable downward pressure to the device 10 while in use while minimizing stress to the user's arms and hands.

Figure 13:
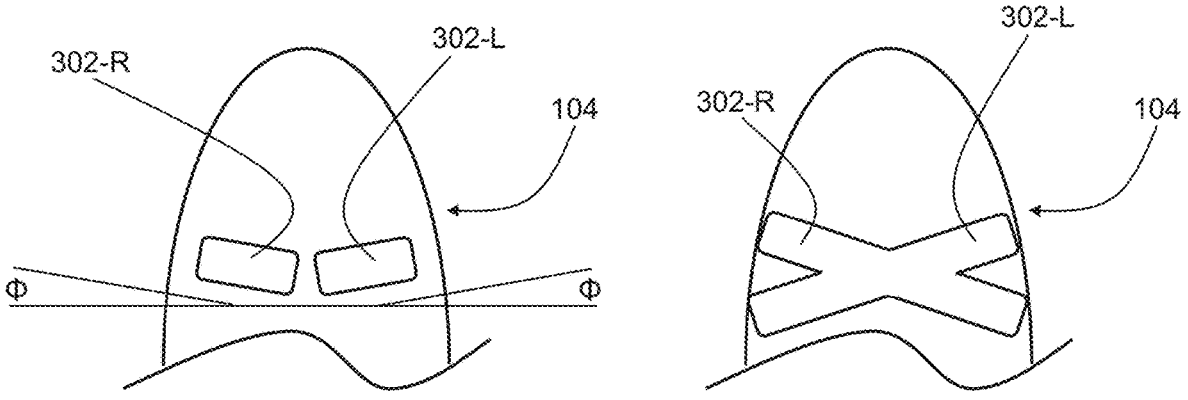
FIG. 13 shows aspects of a massage device attachment system according to exemplary embodiments hereof.

In one exemplary embodiment hereof as shown in FIG. 13, the first device 10-1 may include slots 302-R and 302-L that may be adapted to receive the rear tab 304 or the ridge 202-3 of the second device 10-2 for either a right handed assembly 400 or a left handed assembly 400 respectively. It can be seen that slots 302-R may be similar to slots 302 of FIGS. 8 and 10 for a right-handed user of the combined assembly 400. Accordingly, for a left-handed user of the combined assembly 400, the slots 302-L may be generally mirror images of the slots 302-R. In this way, for a left-handed user, the first and second devices 10-1, 10-2 may be offset by the angle Φ in the mirrored direction.

In Use

Whether used in unison or individually, the ridges 202 are designed to provide cross-fiber friction to the massage recipient's muscles, thereby breaking scar tissue adhesions and lengthening peripheral nerves.

In one exemplary embodiment hereof, the curvature of the surface 201 from which the ridges 202 protrude, the alignment of the ridge's tips 206 with respect to one another and the tips' curvatures are designed to form fit individual muscles (or groups of muscles) of the massage recipient so that the ridges 202 may make contact with, grip, secure and then rake the muscle fibers (using a back-and-forth motion). This action may create cross-fiber friction that eradicates scar tissue adhesion while lengthening and/or elongating associated nerves. In this way, the ridges 202 may act as cross fiber ridges 202. The scar tissue is broken between the muscles, tendons, ligaments and nerves and peripheral nerves are lengthened away from the spinal cord. This action may break down scar tissue adhesions between the muscles and pull and lengthen peripheral nerves away from the spinal cord.

In one example, the first and second ridges 202-1, 202-2 may be used individually for specialized tasks. For instance, the first (and possibly smaller) ridge 202-1 may designed to penetrate between the bone and the muscle. In another example, the third (and possibly larger) ridge 202-3 may be designed to penetrate and compress larger, bulkier muscles such as the massage recipient's "erector spinae".

In another example of use, ridge 202-1 is used to separate and wedge muscle from adjacent bone.

In another example of use, ridge 202-3 is used to perform deep tissue cuts into larger muscle groups as well as different maneuvers of nerve lengthening.

In another example of use, the rear tab 304, being used as a massage ridge 202, is used to perform a deep tissue cut into larger muscle groups with downward pressure of an individual device 10 (e.g., for use on the erector spine or the iliocostalis lumborum on a 90-degree cut).

In another example of use, the combined assembly 400 may be used to exert additional downward pressure with higher precision (e.g., because the combined assembly 400 is gripped with both hands). In this way, the combined assembly 400 may be used to perform deep tissue cuts on larger muscles as well as different nerve lengthening maneuvers. In one example of this type, the assembly 400 may be used to perform a 90-degree cut on the recipients erector spine or the iliocostalis lumborum.

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A combination of massage devices for use by a user performing a body massage, the combination comprising:

a first massage device comprising:

a first handle with a first forward extending thumb portion, the first forward extending thumb portion including a top;

a first plurality of downward extending ridges configured beneath the first forward extending thumb portion; and at least one slot configured with the top of the first forward extending thumb portion;

a second massage device comprising;

a second handle with a second forward extending thumb portion and a back;

a second plurality of downward extending ridges configured beneath the second forward extending thumb portion; and a tab configured with the back of the second handle;

wherein the tab of the second massage device is adapted to fit within the at least one slot of the first massage device.

2. The combination of massage devices of claim 1 wherein the second massage device is configured to combine with the first massage device by inserting the tab of the second massage device into the at least one slot of the first massage device.

3. The combination of massage devices of claim 1 wherein at least one of the second plurality of downward extending ridges is adapted to fit within the at least one slot of the first massage device.

4. The combination of massage devices of claim 3 wherein the second massage device is configured to combine with the first massage device by inserting the at least one of the second plurality of downward extending ridges adapted to fit within the at least one slot of the first massage device into the at least one slot of the first massage device.

5. The combination of massage devices of claim 1 wherein the top includes a top front and a top back defining a top longitudinal axis extending from the top front to the top back, and the at least one slot is oriented at an offset angle with respect to an axis perpendicular to the top longitudinal axis.

6. The combination of massage devices of claim 1 wherein the top includes a top front and a top back defining a top longitudinal axis extending from the top front to the top back, and the at least one slot includes a first slot oriented at a first offset angle with respect to an axis perpendicular to the top longitudinal axis and a second slot oriented at a second offset angle with respect to the axis perpendicular to the top longitudinal axis.

7. A combination of massage devices for use by a user performing a body massage, the combination comprising:

a first massage device comprising:

a first handle with a first forward extending thumb portion, the first forward extending thumb portion including a top;

a first plurality of downward extending ridges configured beneath the first forward extending thumb portion; and at least one slot configured with the top of the first forward extending thumb portion;

a second massage device comprising;

a second handle with a second forward extending thumb portion and a back; and a tab configured with the back of the second handle;

wherein the tab of the second massage device is adapted to fit within the at least one slot of the first massage device.

8. The combination of massage devices of claim 7 wherein the second massage device is configured to combine with the first massage device by inserting the tab of the second massage device into the at least one slot of the first massage device.

9. The combination of massage devices of claim 7 further comprising a second plurality of downward extending ridges configured beneath the second forward extending thumb portion.

10. The combination of massage devices of claim 9 wherein at least one of the second plurality of downward extending ridges is adapted to fit within the at least one slot of the first massage device.

11. The combination of massage devices of claim 10 wherein the second massage device is configured to combine with the first massage device by inserting the at least one of the second plurality of downward extending ridges adapted to fit within the at least one slot of the first massage device into the at least one slot of the first massage device.

12. The combination of massage devices of claim 7 wherein the top includes a top front and a top back defining a top longitudinal axis extending from the top front to the top back, and the at least one slot is oriented at an offset angle with respect to an axis perpendicular to the top longitudinal axis.

13. The combination of massage devices of claim 7 wherein the top includes a top front and a top back defining a top longitudinal axis extending from the top front to the top back, and the at least one slot includes a first slot oriented at a first offset angle with respect to an axis perpendicular to the top longitudinal axis and a second slot oriented at a second offset angle with respect to the axis perpendicular to the top longitudinal axis.

* * * * *